US006085654A

United States Patent [19]

Gunschera et al.

[11] Patent Number: 6,085,654

[45] Date of Patent: Jul. 11, 2000

[54] DEVICE FOR POWDERING PRINTED SHEETS

[75] Inventors: Frank Gunschera, Nussloch; Sven Kerpe, Bruchsal, both of Germany

[73] Assignee: Heidelberger Druckmaschinen Aktiengesellschaft, Heidelberg, Germany

[21] Appl. No.: 09/251,984

[22] Filed: Feb. 17, 1999

[30] Foreign Application Priority Data

Feb. 17, 1998 [DE] Germany ..... 198 06 486

[51] Int. Cl.[7] ..... B41F 23/06

[52] U.S. Cl. ..... 101/424.2; 101/416.1

[58] Field of Search ..... 101/424.2, 419, 101/416.1, 424.1, 420

[56] References Cited

U.S. PATENT DOCUMENTS

| | | | |
|---|---|---|---|
| 2,613,603 | 10/1952 | Ireton | 101/416.1 |
| 3,053,180 | 9/1962 | Doyle | 101/416.1 |
| 5,443,005 | 8/1995 | Platsch | 101/424.2 |
| 5,540,152 | 7/1996 | DeMoore | 101/419 |
| 5,713,285 | 2/1998 | Reed et al. | 101/424.2 |
| 5,746,131 | 5/1998 | Henn et al. | 101/424.2 |

FOREIGN PATENT DOCUMENTS

| | | | |
|---|---|---|---|
| 0 839 650 A1 | 5/1998 | European Pat. Off. . | |
| 2519831 | 11/1976 | Germany | 101/424.2 |
| 21 51 185 B2 | 7/1979 | Germany . | |
| 22 07 983 B2 | 9/1979 | Germany . | |
| 3912459 | 11/1989 | Germany | 101/424.1 |
| 40 40 227 A1 | 6/1992 | Germany . | |
| 44 27 904 A1 | 2/1996 | Germany . | |
| 196 09 438 | 9/1997 | Germany . | |
| 196 43 986 A1 | 5/1998 | Germany . | |

OTHER PUBLICATIONS

Patent Abstracts of Japan No. Hei 4–98140, date Aug. 25, 1992, Device for distributing powder.

Patent Abstracts of Japan No. Sho 64–16331, dated Jan. 26, 1989, Powder spraying device.

*Primary Examiner*—John S. Hilten

*Assistant Examiner*—Anthony H. Nguyen

*Attorney, Agent, or Firm*—Herbert L. Lerner; Laurence A. Greenberg; Werner H. Stemer

[57] ABSTRACT

A device for powdering printed sheets with powder applicator devices switchable back and forth between two operating states and, in a first of the operating states thereof, serving to direct to a given destination a free stream of carrier gas carrying entrained powder, includes, in each of the powder applicator devices, a disposal line formed with an orifice region for channeling therein, in the second of the operating states, a powder gas flow formed by a respective free stream, the powder gas flow being removable by the disposal line; and a sheet-processing printing press including the powdering device, as well as a sheet-processing printing press including a device for indirectly powdering sheets.

5 Claims, 5 Drawing Sheets

DEVICE FOR POWDERING PRINTED SHEETS

BACKGROUND OF THE INVENTION

1. Field of the Invention

The invention relates to a device for powdering printed sheets with powder applicator devices, which are switchable back and forth between two operating states and which, in a first of the operating states thereof, direct to a given destination a free stream of carrier gas carrying entrained powder. The invention also relates to a sheet-fed printing press having a delivery for delivering the printed sheets to a pile station by sheet grippers revolving during operation, and having a device by which powder is distributable to the sheets being transported in the delivery, and also a sheet-fed rotary printing press having a device for indirectly powdering the printed sheets.

A device of the foregoing general type has become known heretofore, for example, from the published Japanese Patent Document JP Hei 5-28634 (U), wherein respective powder nozzles are described as being connected to a supply line that is closable by an electromagnetic valve. Closing and opening of certain supply lines is performed by a controller, which triggers the electromagnetic valves and has an arrangement for specifying the sheet size. The device is provided in the delivery of a sheet-fed printing press and is supposed to prevent the distribution of powder beyond the sheet edges which are oriented in the sheet travel direction. Thus, during delivery of the printed sheets, as a function of sheet size or format, some of the supply lines must be kept closed and the remaining ones must be kept open.

With a device for powdering printed sheets heretofore known from the published German Patent Document DE 40 40 227 A1, for example, it is to a certain extent possible in particular to prevent powder from being deposited on press parts of the delivery of a sheet-fed printing press which are located within the aforementioned edges of the sheets. This heretoforeknown device succeeds in this by not adding the powder to the aforementioned carrier gas steadily but only at a predetermined rhythm or cadence, so that powder application can be limited to those time segments when a particular sheet is moving past the powder applicator devices. To that end, in a chamber containing a bed of powder and communicating with a jet pump, a cloud of powder is created in the aforementioned cadence by intermittently making the surface of the powder bed swirl up; this cloud is then aspirated by the jet pump and admixed with a carrier gas flow passing through the pump, and then blown jointly with this flow onto the respective sheet with the powder applicator devices connected to the outlet of the jet pump. The powder applicator devices thus dispense a steady gas stream during operation, and this stream then carries entrained powder at the aforementioned cadence.

In practical use for powdering printed sheets, which move past the powder applicator devices at the cadence of the sheet-fed printing press, the time intervals during which the gas stream is supposed to be free of powder are many times shorter than those in which it is supposed to carry entrained powder. Especially for the relatively high cadence frequencies that are usual in modern sheet-fed printing presses, it proves to be problematic, with the heretoforeknown device, to keep the gas stream free of powder during the aforementioned brief time intervals.

SUMMARY OF THE INVENTION

It is accordingly an object of the invention to provide a device of the type described at the introduction hereto so that the application of powder is limited as exclusively as possible to the size or format of the sheets.

With the foregoing and other objects in view, there is provided, in accordance with one aspect of the invention, a device for powdering printed sheets with powder applicator devices switchable back and forth between two operating states and, in a first of the operating states thereof, serving to direct to a given destination a free stream of carrier gas carrying entrained powder, comprising, in each of the powder applicator devices, a disposal line formed with an orifice region for channeling therein, in the second of the operating states, a powder gas flow formed by a respective free stream, the powder gas flow being removable by the disposal line.

In accordance with another feature of the invention, the powdering device includes a powder reservoir communicating with the respective disposal line.

In accordance with a further feature of the invention, at least in the orifice region of the respective disposal line, a negative pressure prevails.

In accordance with another aspect of the invention, there is provided a sheet-processing printing press having a delivery for transporting printed sheets to a stacking station via sheet grippers revolving in operation, and having a device for powdering the sheets being transported in the delivery, the powdering device comprising powder applicator devices switchable back and forth between two operating states and, in a first of the operating states thereof, serving to direct to a given destination a free stream of carrier gas carrying entrained powder, each of the powder applicator devices including a disposal line formed with an orifice region for channeling therein, in the second of the operating states, a powder gas flow formed by a respective free stream, the powder gas flow being removable by the disposal line.

In accordance with a concomitant aspect of the invention, there is provided a sheet-processing printing press having a device for indirectly powdering printed sheets, comprising powder applicator devices switchable back and forth between two operating states and, in a first of the operating states thereof, serving to direct to a given destination a free stream of carrier gas carrying entrained powder, each of the powder applicator devices including a disposal line formed with an orifice region for channeling therein, in the second of the operating states, a powder gas flow formed by a respective free stream, the powder gas flow being removable by the disposal line.

With the device according to the invention constructed in this manner, with suitably cadenced or cycled switchover from one operating state to the other and vice versa, at high cadence frequencies of sheet feeding, it is possible both to demarcate intervals with and without an application of powder sharply from one another and also, to the maximum possible extent, to prevent an application of powder beyond the sheet edges which are oriented in the sheet travel direction. With this device according to the invention, intermittent powder application during sharply demarcated time intervals is possible, especially without cadence or cyclic loading of the carrier gas with powder. A powder gas generator can thus be provided that creates a powder-laden gas stream uninterruptedly during operation.

If, in an exemplary embodiment, the powder nozzle of the respective powder applicator device, when a free space is left surrounding it, is inserted into the disposal line in the orifice region thereof, the result is an especially simple way of varying the respective free stream with the aid of a respective shutter, which closes the disposal line in the orifice region thereof in cadenced or cyclic manner, so that the aforementioned free stream forms a powder gas flow that is oriented counter to the direction of the stream and that can be removed by the disposal line. Suitable shutters can be formed, for example, by closure plates which can be slid forward and backward electromagnetically, or by rotating perforated disks, so that extremely brief switching times can be achieved for changing the operating states of the powder applicator devices at relatively high switching frequencies.

In an advantageous refinement of the device according to the invention, a powder reservoir communicating with the respective disposal line is provided. This makes it possible to return the powder gas flow, removed via the disposal line, to the powder reservoir, so that powder pollution of the surroundings can be effectively prevented at least in the second operating state of the powder applicator devices.

Another advantageous refinement furthermore reduces vagabond powder components in the first operating state of the powder applicator devices. To that end, provision is made for a negative pressure to prevail in the respective disposal line, at least in the orifice region of that disposal line. As a result of this provision, powder particles that do not reach the intended target thereof, together with the respective free stream, are aspirated into the disposal line.

Other features which are considered as characteristic for the invention are set forth in the appended claims.

Although the invention is illustrated and described herein as embodied in a device for powdering printed sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
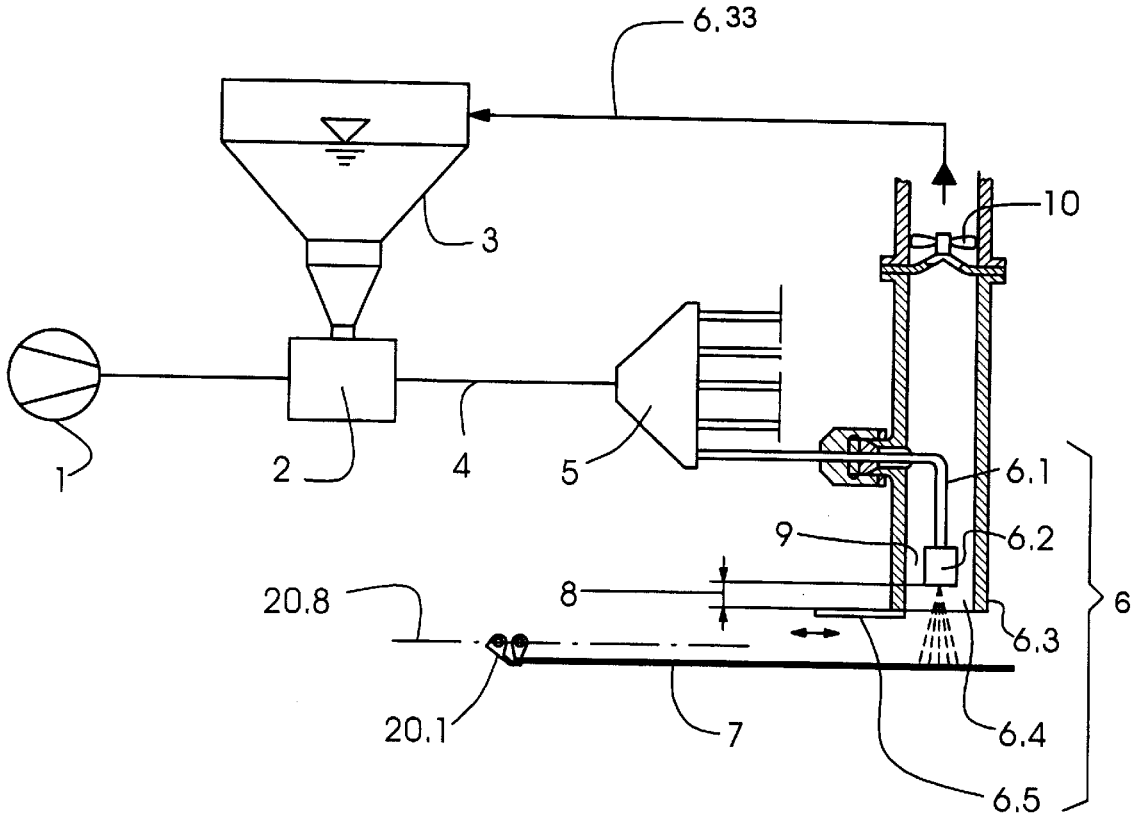
FIG. 1 is a diagrammatic and schematic view of an exemplary embodiment of the device for powdering printed sheets in accordance with the invention.

Referring now to the drawings and, first, particularly to FIG. 1 thereof, there is shown therein, diagrammatically and schematically, the device according to the invention, which includes a jet pump 2, that is drivable by a blower 1, and admixes powder, taken from a powder reservoir 3, with a carrier gas flow prevailing in the pump during operation. The powder-laden carrier gas flow passes via a main line 4 into a distributor 5, to which a plurality of powder applicator devices 6 are connected. Each powder applicator device 6 includes one supply line 6.1 connected to the distributor 5; one powder nozzle 6.2 connected to the supply line; and a disposal line 6.3 with an orifice region 6.4 that is switchable in cadenced or rhythmic manner from a closed state to an open state, and vice versa, by a shutter 6.5.

The view selected in FIG. 1 of the shutter 6.5 is supposed merely to illustrate the principle of the mode of operation thereof represented by the double-headed arrow, i.e., the opening and closing, respectively, of the disposal line 6.3 in the orifice region 6.4 thereof. Examples of embodiments of suitable shutters are described hereinafter in conjunction with FIGS. 2 and 3.

In FIG. 1, only one of the powder applicator devices 6 is shown, and specifically in the first operating state thereof, wherein the shutter 6.5 uncovers or opens the orifice region 6.4, so that a free stream dispensed by the powder nozzle 6.2 strikes the intended target thereof, in this case, a sheet 7 of paper. The other powder applicator devices are suggested by showing a fragment of a respective supply line, each fragment being connected to the distributor 5. The number of provided powder applicator devices which may be inferred from FIG. 1 is merely by way of example, however.

An uninterrupted flow of powder-laden carrier gas passes during operation through the powder nozzle 6.2 diagrammatically shown in FIG. 1, so that the powder nozzle 6.2 dispenses a steady free stream of powder, entrained by carrier gas, that is oriented so that the sheets 7 successively passing the powder nozzle 6.2 can be acted upon thereby. The powder nozzle 6.2 inserted into the disposal line 6.3, at a spaced distance 9 from the actual orifice of the orifice region 6.4 of the disposal line 6.3, upline from the orifice with regard to the direction of the aforementioned free stream, leaving a free space 9 between the powder nozzle 6.2 and the wall of the disposal line 6.3. In the second operating state of the powder applicator device 6 shown, the free stream dispensed by the powder nozzle 6.2 and including powder and carrier gas entraining the powder, is deflected by the shutter 6.5 closing the orifice region 6.4, and thus forms a powder gas flow that is channeled by the disposal line 6.3 in the orifice region 6.4 thereof and that can be removed via the disposal line 6.3. To that end, the disposal line 6.3, as suggested in FIG. 1 by the line 6.33 provided with arrows, is preferably returned into the powder reservoir 3.

The negative pressure which, in a preferred refinement of the device, prevails at least in the orifice region 6.4 of the disposal line 6.3 during operation, is generated in the embodiment of FIG. 1 by a blower 10, presented here, by way of example, as an axial blower, to the suction side of which a line segment that includes the orifice region 6.4 of the disposal line 6.3 is connected, and to the compression side of which a line segment 6.33 of the disposal line 6.3 opening into the powder reservoir 3 is connected.

In a practical use of the device according to the invention, the powder applicator devices 6, selected in accordance with the size or format of the sheets 7 to be powdered, are in the first operating state thereof whenever, and as long as, a respective one of the sheets 7 succeeding one another in cadence is moving past the respective powder nozzle 6.2, while in the intervening time intervals it is in the second operating state thereof. These changes of state which, especially in high-speed printing presses, succeed one another with a high cadence frequency, and which have extremely brief time intervals during which no sheet 7 is moving past the powder nozzles 6.2, are advantageously realized, as already indicated above, by electromagnetically actuatable shutters for opening and closing the orifice region 6.4 of the respective disposal line 6.3.

Figure 2:
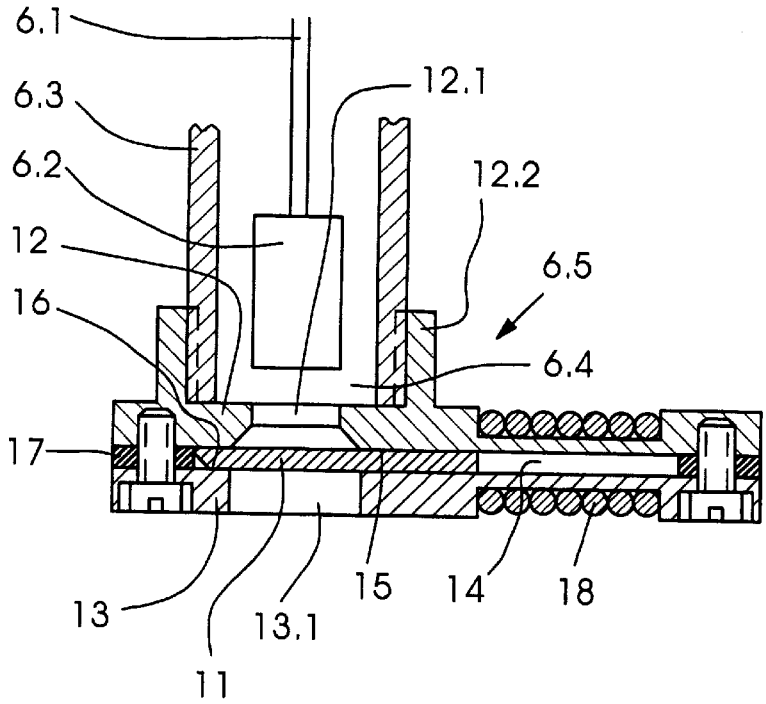
FIG. 2 is an enlarged fragmentary sectional view of FIG. 1 showing an exemplary embodiment of the invention for channeling a free stream and converting it into a powder gas flow that is removable by a disposal line, a shutter being assigned to an orifice region of the disposal line.

In FIG. 2, an exemplary embodiment of one such shutter is shown. It includes a permanent-magnet closure plate 11 that is inserted into a free space 14 formed between an upper guide part 12 and a lower guide part 13. The upper guide part 12 is screwed to the end of the disposal line 6.3 formed with the orifice region 6.4 by a female-thread attachment 12.2 formed thereon, the latter having on the underside thereof a sliding surface 15 for the top side of the closure plate 11. The lower guide part, on the top side thereof, is formed with a sliding surface for the underside of the closure plate 11, and is screwed to the upper guide part 12, with a sealing plate 17 interposed. The sealing plate 17 has a recess which forms the lateral boundaries of the free space 14, and it has a thickness adapted to the thickness of the closure plate 11, so that the closure plate 11 is guided slidingly along the sliding surfaces 15 and 16 of the upper and lower guide parts 12 and 13.

The upper and the lower guide parts 12 and 13 have an opening 12.1 and 13.1, respectively, opposite the powder nozzle 6.2, a free stream of powder entrained by the carrier gas passing or being dispensed through the openings 12.1 and 13.1 by the powder nozzle 6.2, in the open state of the orifice region 6.4, or in other words in the first operating state of the powder applicator device 6.

The boundaries of the free space 14 located in front of and behind the plane of the drawing, as shown in FIG. 2, form respective guide surfaces, on which the end faces of the closure plate 11 located in front of and behind the plane of the drawing are guided in a sliding manner. The free space 14 and the closure plate 11 are otherwise dimensioned so that the closure plate can assume the position shown in FIG. 2 inside the free space, as well as a position shifted so far to the right thereof that the passage through the openings 12.1 and 13.1 is uncovered; in the position shown in FIG. 2 of the drawing, the passage through the openings 12.1 and 13.1 is blocked.

To displace the closure plate 11 from one of these positions to the other, an induction coil 18 of reversible polarity is provided, surrounding the upper and lower guide parts 12 and 13. This coil 18 is disposed in a portion of the upper and lower guide parts 12 and 13 that laterally adjoins the openings 12.1 and 13.1 and, depending upon the polarity thereof, it displaces the closure plate 11 out of the position shown in FIG. 2 to the righthand side into a position that uncovers the openings 12.1 and 13.1, or out of the latter position into the position shown. The sealing plate 17 forms a respective stop that limits the adjustment of the closure plate 11 and is formed of rubber-elastic material for that purpose.

Figure 3:
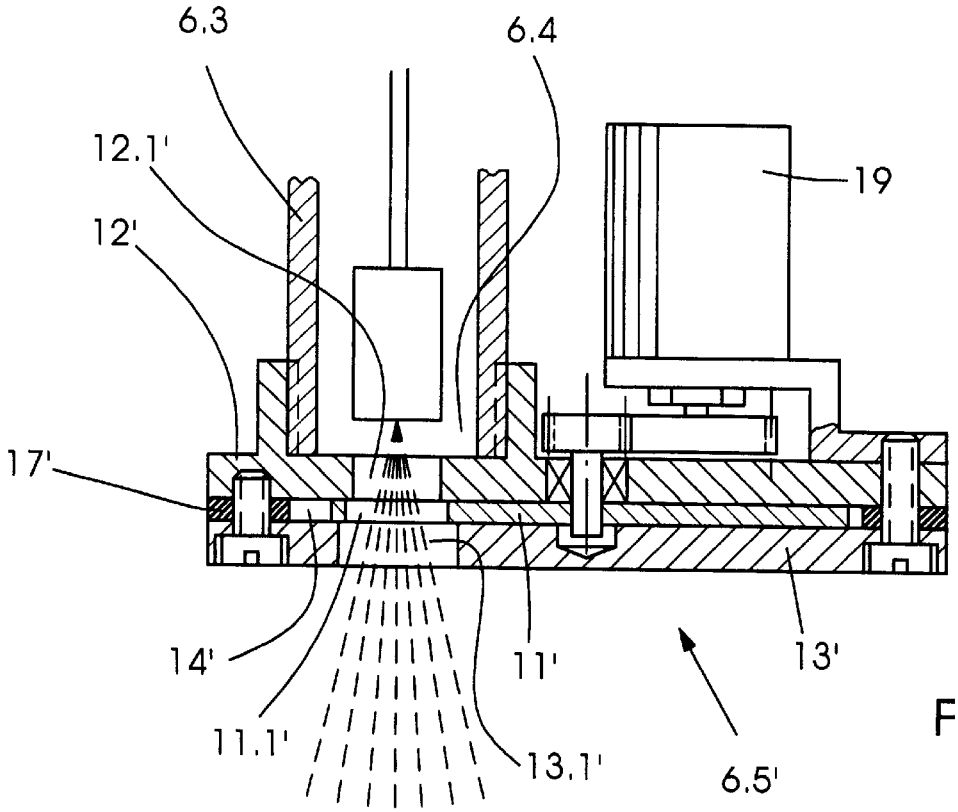
FIG. 3 is a view like that of FIG. 2, showing another exemplary embodiment of the invention having a shutter modified, however, over that of the embodiment of FIG. 2.

As diagrammatically shown in FIG. 3, instead of the linearly adjustable closure plate 11 and the induction coil 18 that adjusts it, it is also possible, for example, to provide a perforated disk 11', which is rotatable about an axis perpendicular to the sliding surfaces 15 and 16 in a suitably shaped free space 14' in the form of a recess in a sealing plate 17' inserted between the upper and lower guide parts 12' and 13'; a stepping motor 19, for example, serves for driving the perforated disk so that an opening 11'.1 provided in the perforated disk 11' uncovers the passage through the openings 12.1' and 13.1' at the required cadence of powder application.

The view in FIG. 3 represents the first operating state of one of the powder applicator devices 6.

For varying the free stream as described hereinabove with regard to exemplary embodiments using shutters, and for forming a powder gas flow that is channeled by the disposal line 6.3 in the orifice region 6.4 thereof and can be removed by the disposal line from the free stream, it is unnecessary, in the case of a suitably selected negative pressure in the orifice region 6.4, to close the orifice region 6.4 tightly with the shutter. In the case of the exemplary embodiment of FIG. 3, the sealing plate 17' and the lower guide part 13' can be dispensed with, and the perforated disk 11' can be provided, a gap being defined between the latter and the upper guide part 12'.

The conversion of the free stream into a powder gas flow that can be removed by the disposal line is effected in this case with the cooperation of the negative pressure prevailing in the orifice region 6.4, and the perforated disk 11', when the latter assumes a rotary position corresponding to the second operating state, in which a closed portion of the perforated disk 11' is located facing the orifice region 6.4.

The use described thus far of a shutter in conjunction with the powder nozzle 6.2 inserted into the orifice region 6.4 of the disposal line 6.3 leaving a free space 9 is, while preferred, only one of the possible ways of achieving the aforementioned conversion of the free stream.

Figure 4:
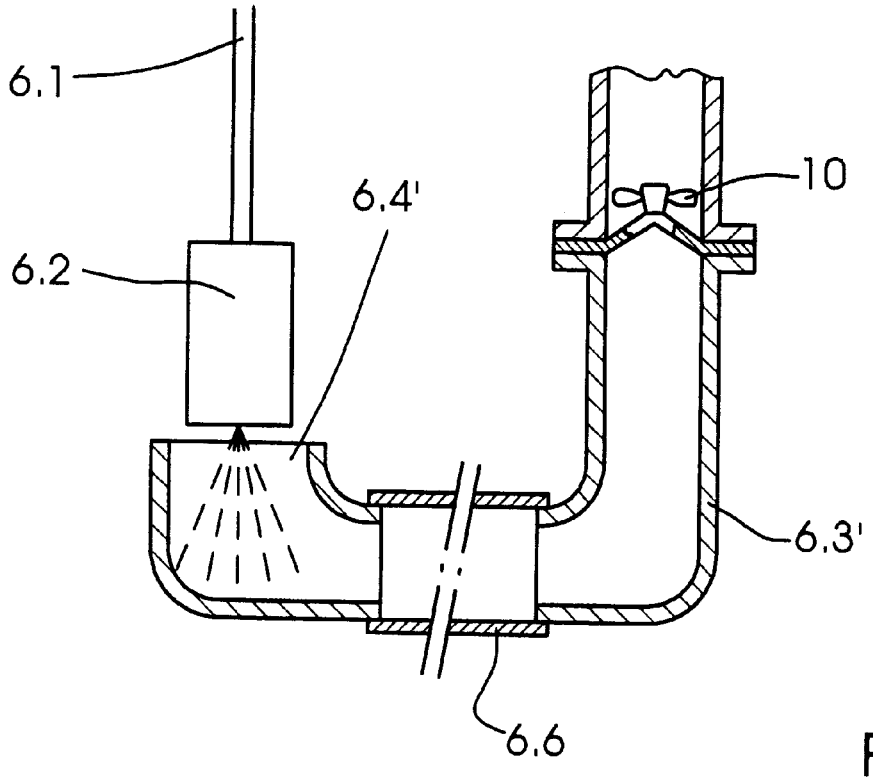
FIG. 4 is a sectional view of an exemplary embodiment of the invention, for channeling the free stream and converting it into a powder gas flow that is removable via the disposal line without using a shutter.

As suggested in FIG. 4, another possibility is, for example, in the second operating state of a suitably constructed powder applicator device, for the free stream to be carried directly into the orifice region 6.4' of a disposal line 6.3', with a negative pressure prevailing in the orifice region 6.4', and for the free stream, in the first operating state, to flow away without modification, so that it drops off its powder at the intended target. The unmodified outflow is made possible by disposing the orifice region 6.4' at a distance from the space occupied by the free stream, counter to what FIG. 4 shows. The removal of the orifice region 6.4' from this space, and the introduction thereof into this space, can be performed, in the case of the embodiment shown in FIG. 4, by reciprocatingly swinging the orifice region 6.4' at right angles to the plane of the drawing. To that end, in the construction of FIG. 4, the disposal line 6.3' has at least one elastic portion 6.6, which enables the aforementioned swinging or swiveling of the orifice region 6.4' back and forth. The reciprocal pivoting must then be performed in a cyclical or rhythmic manner. No attempt has been made to illustrate in the drawings a suitable swinging or swiveling mechanism for the purpose described. Instead of being reciprocatingly swung or swiveled, the orifice region 6.4' can also be pivoted or displaced linearly back and forth crosswise to the flow direction of the free stream emerging from the powder nozzle 6.2 during operation.

Figure 5:
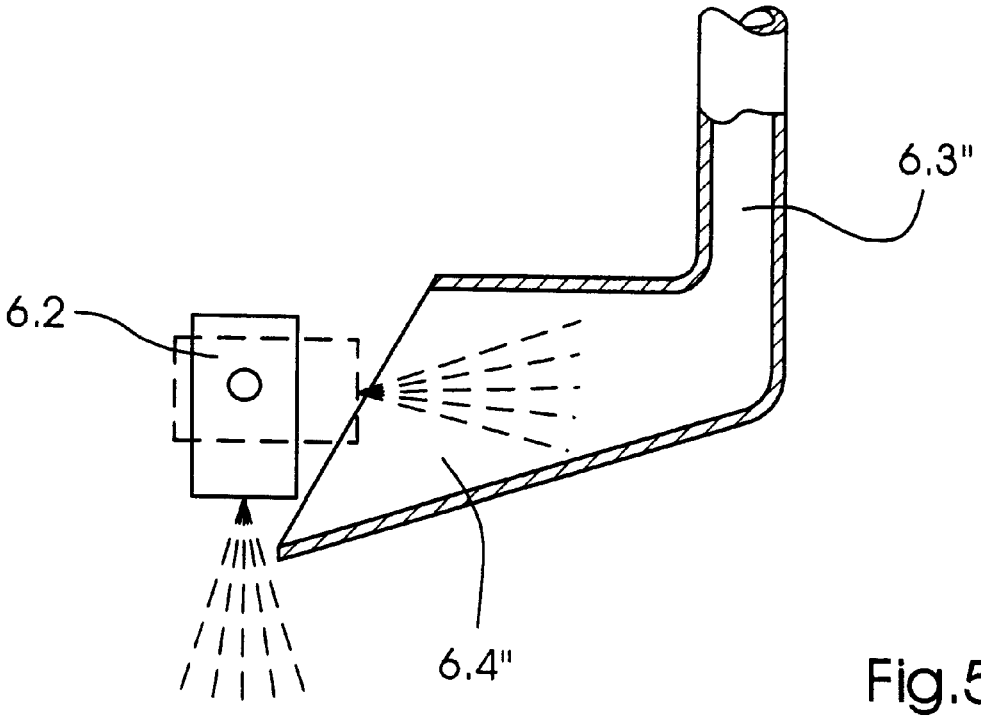
FIG. 5 is a sectional view of another exemplary embodiment, again functioning without a shutter, for channeling the free stream and converting it into a powder gas flow that is removable via the disposal line.

In FIG. 5, a further option for varying the free stream in this manner is shown, in which there is formed from the free stream, a powder gas flow that is channeled in the orifice region 6.4" of the disposal line 6.3" and can be removed by this disposal line. To that end, the actual orifice of the orifice region 6.4" is directed laterally towards the free stream, and the powder nozzle 6.2, in a manner not shown in the drawings, is disposed so as to be pivotable in a cyclical manner so that, in the first operating state corresponding to the powder nozzle 6.2 shown in solid lines, the free stream blows past the actual orifice of the orifice region 6.4" of the disposal line 6.3" and, in the second operating state corresponding to the powder nozzle 6.2 shown in broken lines, it blows into the orifice region 6.4". Once again, a negative pressure prevails, at least in the orifice region 6.4".

Figure 6:
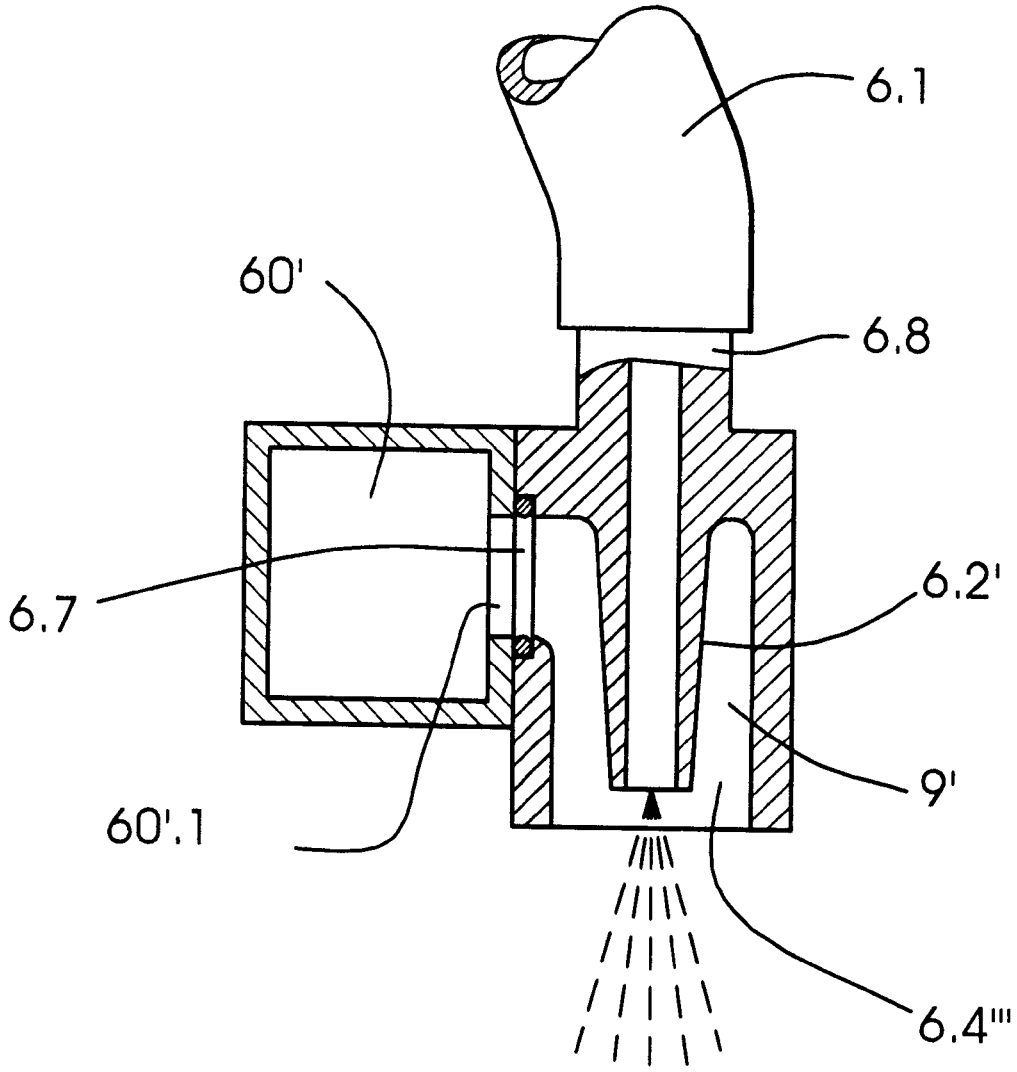
FIG. 6 is a sectional view of an embodiment of the invention differing from that of FIG. 1, the view being of a portion of a powder applicator device with a powder nozzle inserted into the orifice region of a disposal line.

Whereas in FIG. 1, only the functionally mutual association of the disposal line 6.3 thereat and the powder nozzle 6.2 inserted into the orifice region 6.4 thereof are shown, FIG. 6 diagrammatically shows an optimal constructional embodiment thereof. Instead of a number of disposal lines corresponding to the number of powder nozzles, there is only one collective line 60', in the form of a square pipe seen in cross section in FIG. 6, with a number of inlets 60'.1 corresponding to the number of powder nozzles being provided on one side surface of the square pipe. An integral or one-piece molded part sealingly adjoins each of these inlets 60'.1, and this molded part forms the orifice region 60.4"' and the powder nozzle 6.2' that is inserted therein, leaving a free space 9'. The free space 9' is formed by a chamber that surrounds the powder nozzle 6.2' and that has an outlet opening, for the free stream dispensed by the powder nozzle 6.2' during operation, and a lateral opening 6.7, that communicates with the collective line 60' via the respective inlet 60'.1. The aforementioned one-piece molded part also forms an inlet stub 6.8, onto which a respective one of the supply lines 6.1 is slipped. For the herein aforediscussed cyclic variation of the free stream by a shutter optionally formed as shown in FIG. 2 or FIG. 3, the outlet end of the powder nozzle 6.2' is also recessed upline, in terms of the flow direction of the free stream, relative to the outlet opening of the chamber forming the free space 9'.

Figure 7:
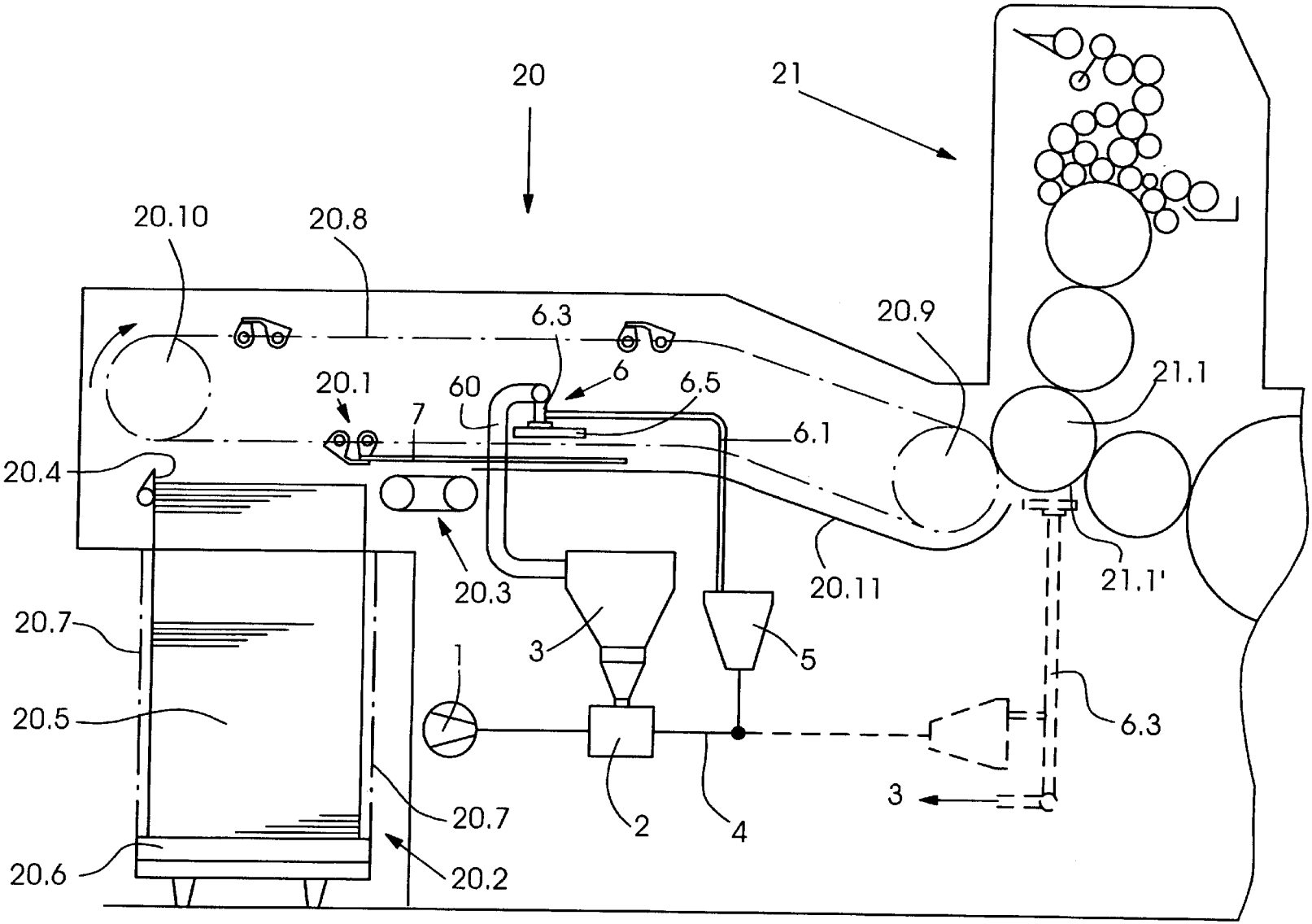
FIG. 7 is a diagrammatic and schematic view of a delivery disposed downline from a processing station of a sheet-fed printing press, the delivery being equipped with the device for directly powdering sheets, the device being shown in solid lines, and of the printing press equipped with the device for indirectly powdering sheets via a cylinder of a processing station disposed upline of the delivery system and shown in broken lines.

In the case of the sheet-fed printing press shown diagrammatically in FIG. 7, the powdering of the printed sheets takes place in the delivery 20 of the printing press, which delivers the printed sheets 7 to a pile-forming or stacking station 20.2 with the aid of sheet grippers 20.1 which revolve during operation, after the sheet grippers 20.1 have taken over the respective sheets 7 from the last processing station 21 of the printing press. The last processing station may be represented by a printing unit or a finishing unit.

In the case at hand, by way of example, the last processing station is a printing unit operating by the wet offset process, having impression cylinders 21.1 from which the sheet grippers 20.1 have taken a respective sheet 7 so as to feed it to a sheet brake 20.3 assigned to the stacking station 20.2, and then release it after the sheet 7 has been engaged by the sheet brake 20.3, so that the respective sheet 7 finally also leaves the sheet brake 20.3 at reduced speed and stops, when the leading edge of the sheet 7 meets a leading-edge stop or front lay 20.4, thereupon dropping to form a pile 20.5 that builds up during operation on a pile support 20.6 that can be raised and lowered, the pile specifically being formed thereon while the support is being lowered in a cyclic manner. All that is seen of the hoisting mechanism are the lifting chains 20.7 represented by dot-dash or phantom lines in FIG. 7.

The revolution of the sheet grippers 20.1 during operation is accomplished by a pair of revolving conveyor chains 20.8 which carry the sheet grippers 20.1. Each conveyor chain 20.8 wraps around a driven delivery sprocket wheel 20.9 and a deflection sprocket wheel 20.10 and otherwise is guided in a non-illustrated chain guide.

The sheet grippers 20.1 guide a respective sheet 7 over an air cushion that is formed between the sheet 7 and a sheet guide baffle 20.11 that extends in one direction as far as the impression cylinder 21.1 and in the other as far as the sheet brake 20.3; the course of the guide baffle follows that of the lower runs of the guide chains 20.8. The sheets 7 engaged by the sheet grippers 20.1 thus also follow the course of the sheet guide baffle 20.11 and are subjected, in a portion of the guide baffle, to the powder nozzles 6.2 which, though not shown in FIG. 7, are directed towards the top of the sheets 7 in the powder applicator devices 6 which, for example, are equipped with shutters 6.5 as in FIG. 2. The end of the respective powder applicator device 6 that has the particular powder nozzle 6.2 is located a slight distance above the sheet gripper 20.1 passing through the aforementioned portion, i.e., the sheet grippers 20.1 move past the shutters 6.5 or 6.5' located above them, the sheet grippers being spaced only slightly apart from the shutters as they move. In this case, the intended target towards which the free streams dispensed by the powder applicator devices in the first operating state thereof are directed is the aforementioned top side of the respective sheet 7.

As already noted hereinbefore, during operation, the device according to the invention enables an uninterrupted admixture of powder into the gas flow generated by the blower 1, so that a respective powder nozzle 6.2 experiences a flow therethrough of the powder entrained by the free stream, even if the powder applicator devices 6 are closed. Compared with a cyclic admixing of the powder, which involves unavoidable idle times, however, this allows a certain freedom of choice as to where the parts of the device that generate powder entrained by a gas stream are placed.

In the case of the printing press shown in FIG. 7, to be able to equip it with the device according to the invention, the space located, for example, under the sheet guide baffle 20.11 is provided to accommodate the aforementioned parts. However, it is recommended that the device according to the invention be provided with an automatic refill device for filling the powder reservoir 3 with powder.

The parts of the device according to the invention, which generate the gas stream that entrains the powder may also, however, be disposed outside the printing press, for example, on one of the side walls thereof.

As suggested in FIG. 7, the disposal lines 6.3 can be combined into a collective line 60, via which any powder not applied to the sheets 7 is returned to the powder reservoir 3. This collective line 60 would then, like the supply lines 6.1, lead laterally out of the space between the upper and lower runs of the conveyor chains 20.8.

As also seen in FIG. 4, when the printing press is equipped with the device according to the invention, there is no limitation to directly applying the powder to the sheets 7. The powder nozzles 6.2, not shown in FIG. 7, which are inserted into a respective disposal line 6.3 of the device according to the invention can also be used for powdering the sheets 7 indirectly, and to that end can be directed, for example, towards a jacket surface 21.1' formed on a sheet-feeding cylinder of a processing station and are capable, in the cadence or cycle of the printing press, of powdering a portion of this jacket surface 21.1' which, after the powder has been applied to this portion, contacts the respective sheet 7.

In that case, the intended target towards which the free streams dispensed from the powder applicator devices, in the first operating state thereof, are directed is the aforementioned portion of the jacket surface 21.1' of the sheet-feeding cylinder which, in the illustrated exemplary embodiment of FIG. 7, is the impression cylinder 21.1.

Regardless of whether the device according to the invention is used for direct or indirect powdering, it has the further advantage of enabling powder application in a manner dependent upon the printed image on the sheets 7. To that end, for example, when shutters are used, the shutters are triggered in such a way that the beginning and end of those time intervals in which the shutters uncover the respective orifice 6.4 are correlated with the printed image. This prevents applying powder unnecessarily, and thus optimizes the powder supply that is required.

We claim:

1. A device for powdering printed sheets with powder applicator devices switchable back and forth between two operating states and, in a first of the operating states thereof, serving to direct to a given destination a free stream of carrier gas carrying entrained powder, comprising:

a disposal line in each of the powder applicator devices, said disposal line formed with an orifice region;

a nozzle located within said orifice region and adapted for directing said free stream to said given destination; and a shutter located within said orifice region and adapted for covering said orifice region in the second of the operating states.

2. The powdering device according to claim 1, including a powder reservoir communicating with the respective disposal line.

3. The powdering device according to claim 1, wherein, at least in said orifice region of the respective disposal line, a negative pressure prevails.

4. A sheet-processing printing press having a delivery for transporting printed sheets to a stacking station via sheet grippers revolving in operation, and having a device for powdering the sheets being transported in the delivery, the powdering device comprising;

powder applicator devices switchable back and forth between two operating states and, in a first of the operating states thereof, serving to direct to a given destination a free stream of carrier gas carrying entrained powder, a disposal line in each of the powder applicator devices, said disposal line formed with an orifice region;

a nozzle located within said orifice region and adapted for directing said free stream to said given destination; and a shutter located within said orifice region and adapted for covering said orifice region in the second of the operating states.

5. A sheet-processing printing press having a device for indirectly powdering printed sheets, comprising:

powder applicator devices switchable back and forth between two operating states and, in a first of the operating states thereof, serving to direct to a given destination a free stream of carrier gas carrying entrained powder, a disposal line in each of the powder applicator devices, said disposal line formed with an orifice region;

a nozzle located within said orifice region and adapted for directing said free stream to said given destination; and a shutter located within said orifice region and adapted for covering said orifice region in the second of the operating states.

* * * * *